US007118346B2

(12) United States Patent
Read

(10) Patent No.: US 7,118,346 B2
(45) Date of Patent: Oct. 10, 2006

(54) COMPRESSOR BLADE

(75) Inventor: Simon Read, Derby (GB)

(73) Assignee: Rolls-Royce plc, London (GB)

( * ) Notice: Subject to any disclaimer, the term of this patent is extended or adjusted under 35 U.S.C. 154(b) by 56 days.

(21) Appl. No.: 10/793,907

(22) Filed: Mar. 8, 2004

(65) Prior Publication Data

US 2005/0008493 A1 Jan. 13, 2005

(30) Foreign Application Priority Data

Mar. 26, 2003 (GB) ..... 0307039.8

(51) Int. Cl.
*F01D 5/18* (2006.01)
*F01D 5/16* (2006.01)

(52) U.S. Cl. ..... 416/232; 416/229 A; 416/243; 416/500; 416/248

(58) Field of Classification Search ..... 416/232, 416/248, 239, 243, 229 A, 500; 415/9
See application file for complete search history.

(56) References Cited

U.S. PATENT DOCUMENTS 3,628,226 A * 12/1971 Nelson ..... 29/889.72
4,364,160 A 12/1982 Eiswerth
5,063,662 A * 11/1991 Porter et al. ..... 148/671
5,106,593 A * 4/1992 Mizuishi et al. ..... 117/215
5,443,367 A 8/1995 Samit
5,490,764 A 2/1996 Schilling
6,786,696 B1 * 9/2004 Herman et al. ..... 416/96 R

FOREIGN PATENT DOCUMENTS

| | | | |
|---|---|---|---|
| EP | 468221 | A | 1/2002 |
| GB | 811586 | P | 4/1959 |
| GB | 827289 | P | 2/1960 |
| GB | 855777 | P | 12/1960 |
| GB | 904546 | P | 8/1962 |
| JP | 10047004 | P | 7/1996 |

* cited by examiner

*Primary Examiner*—Ninh H. Nguyen
(74) *Attorney, Agent, or Firm*—W. Warren Taltavull; Manelli, Denison & Selter PLLC

(57) ABSTRACT

A compressor blade (26) comprises an aerofoil (36) and a root (38). The aerofoil (36) comprises a concave wall (40) extending from a leading edge (44) to a trailing edge (46) and a convex wall (42) extending from the leading edge (44) to the trailing edge (46). The aerofoil (36) defines at least one internal chamber (48). The root (38) is connected to the aerofoil (36) and the root (38) has a base (50) remote from the aerofoil (38) and at least one aperture (52) extends from the base (50) to the at least one internal chamber (48) in the aerofoil (36). The dimensions, shape and position of the least one aperture (52) are selected such that the root (38) is deformable. This reduces the weight of the containment region of a fan casing (28).

22 Claims, 3 Drawing Sheets

COMPRESSOR BLADE

FIELD OF THE INVENTION

The present invention relates to a compressor blade for a turbomachine, and in particular the present invention relates to a fan blade for a turbofan gas turbine engine.

BACKGROUND OF THE INVENTION

A turbofan gas turbine engine comprises a fan, which comprises a fan rotor and a number of circumferentially spaced radially outwardly extending fan blades secured to the fan rotor. The fan is surrounded by a fan casing, which defines a fan duct. The fan casing is also arranged to contain one or more of the fan blades in the unlikely event that a fan blade becomes detached from the fan rotor.

If a fan blade becomes detached from the fan rotor, due to impact from a large foreign body, e.g. a bird, the released fan blade strikes a main fan casing containment region. The fan blade generally progressively breaks up under a buckling action. The fan blade increases in strength from the tip to the root and at some position between the tip and the root the remaining portion of the fan blade, including the root, no longer buckles. The remaining portion of the fan blade has substantial mass and is accelerated to impact a rear fan containment region of the fan casing.

It is necessary to provide additional material to the rear fan containment region of the fan casing to contain the remaining portion of the fan blade. The additional material may be in the form of an increase in thickness, the provision of ribs, honeycomb liners etc, which dissipate the impact energy by plastic deformation of the material. However, these methods of protecting the rear fan containment region add weight to the turbofan gas turbine engine.

SUMMARY OF THE INVENTION

Accordingly the present invention seeks to provide a novel compressor blade, which reduces, preferably overcomes, the above-mentioned problems.

Accordingly the present invention provides a compressor blade comprising an aerofoil and a root, the aerofoil comprising a concave wall extending from a leading edge to a trailing edge and a convex wall extending from the leading edge to the trailing edge, the aerofoil defining at least one internal chamber, the root being connected to the aerofoil, the root having a base remote from the aerofoil and at least one aperture extending from the base to the at least one internal chamber in the aerofoil, the dimensions, shape and position of the least one aperture are selected such that the root is deformable.

Preferably the compressor blade is a fan blade.

The root may be dovetail shaped or firtree shaped in cross-section.

The root may be connected to the aerofoil by a shank, the at least one aperture extending through the shank.

There may be a plurality of apertures extending from the base of the root to the at least one chamber.

The aerofoil may have a plurality of internal chambers, the at least one aperture extending to at least one of the internal chambers.

The at least one aperture may be at a position mid way between the ends of the base of the root.

The at least one aperture may be at a position mid way between the sides of the base of the root.

The aperture may be circular, rectangular, square or other suitable shape in cross-section.

The maximum dimension of the aperture is limited by the dimension of the at least one internal chamber in the aerofoil.

Preferably the compressor blade comprises two or more sheets and the sheets are diffusion bonded together.

Preferably the at least one aperture is provided with a seal.

Preferably at least one of the sheets has been superplastically formed.

The at least one internal chamber may be evacuated.

Alternatively the at least one chamber may be at least partially filled with a vibration damping material.

BRIEF DESCRIPTION OF THE DRAWINGS

The present invention will be more fully described by way of example with reference to the accompanying drawings in which.

DETAILED DESCRIPTION OF THE INVENTION

Figure 1:
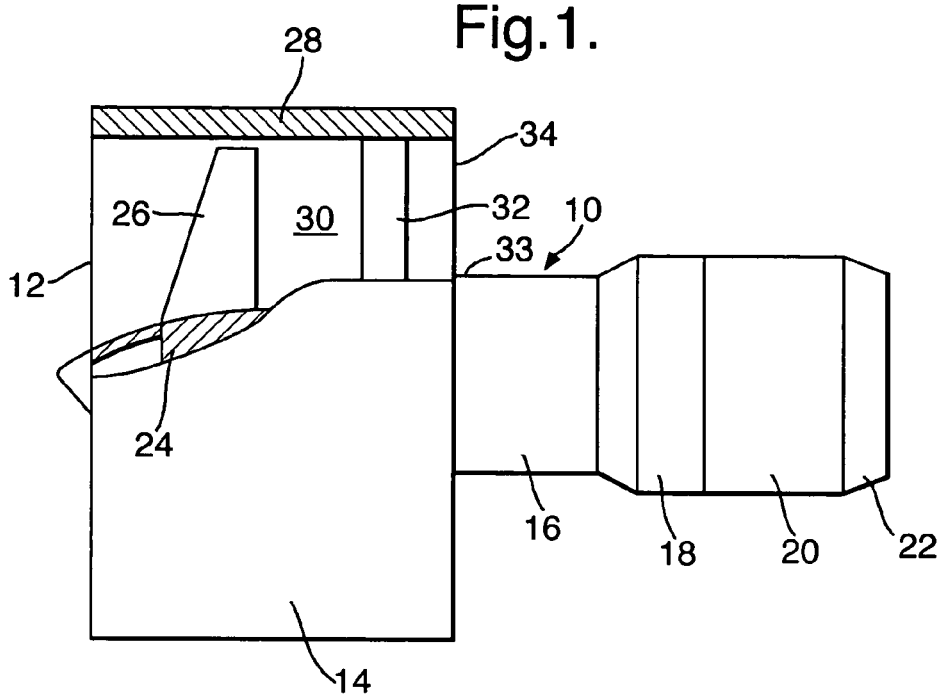
FIG. 1 shows a turbofan gas turbine engine having a fan blade according to the present invention.

A turbofan gas turbine engine 10, as shown in FIG. 1, comprises in axial flow series an intake 12, a fan section 14, a compressor section 16, a combustion section 18, a turbine section 20 and an exhaust 22. The turbine section 20 comprises one or more turbine rotors (not shown) arranged to drive one or more compressor rotors (not shown) in the compressor section 16. The turbine section 20 also comprises one or more turbine rotors (not shown) arranged to drive a fan rotor 24 of the fan section 14.

The fan section 14 comprises a plurality of circumferentially spaced radially outwardly extending fan blades 26 secured to the fan rotor 24. The fan section 14 also comprises a fan casing 28 surrounding and arranged coaxially with the fan rotor 24. The fan casing 28 partially defines a fan duct 30, which has a fan exhaust 34. The fan casing 28 is secured to a core engine casing 33 by a plurality of circumferentially spaced radially extending fan outlet guide vanes 32, which extend between and are secured to the fan casing 28 and the core engine casing 33.

A fan blade 28 according to the present invention comprises an aerofoil portion 36 and a root portion 38, as shown more clearly in FIGS. 2, 3, 4 and 5. The aerofoil portion 36 of the fan blade 26 comprises a concave wall 40 and a convex wall 42, both of which extend from a leading edge 44 to a trailing edge 46. The concave wall 40 and convex wall 42 also at least partially define at least one internal chamber 48 within the aerofoil portion 36 of the fan blade 26. The internal chamber 48 is provided with a vibration damping material, for example a viscoelastic vibration damping material.

The root portion 38 comprises a base 50 remote from the aerofoil portion 36 and at least one aperture 52 extending from the base 50 through the root portion 38 to the internal chamber 48 within the aerofoil portion 36. The root portion 38 also comprises angled surfaces 54 which are arranged to confront and abut correspondingly shaped surfaces on a corresponding one of a plurality of axially extending slots in the periphery of the fan rotor 24 to retain the fan blade 26 on the fan rotor 24. In this example the root portion 38 is dovetail shaped in cross-section, but the root portion 38 may be firtree shaped in cross-section. The base 50 of the root portion 38 has ends 56 and 58 and sides 60 and 62. The root portion 38 is curved to locate in the axially extending slot in the periphery of the fan rotor 24. The ends 56 and 58 of the base 50 of the root portion 38 are radially adjacent the leading edge 44 and trailing edge 46 of the aerofoil portion 36 at the axial ends of the fan blade 26. The sides 60 and 62 of the base 50 of the root portion 38 are radially adjacent the concave wall 40 and convex wall 42 of the aerofoil portion 36.

The at least one aperture 52 is dimensioned, shaped and positioned in the root portion 38 such that the root portion 38 is at least deformable and/or frangible. In this example a single aperture 52 is positioned midway between the ends 56 and 58 of the base 50 and midway between the sides 60 and 62 of the base 50.

The fan blade 26 is preferably manufactured from two or more metal, e.g. titanium alloy, sheets, which have been diffusion bonded together. If the fan blades 26 are manufactured from two metal sheets, the metal sheets are hot formed away from each other by gas pressure to produce an internal chamber 48 within the aerofoil portion 36.

Figure 6:
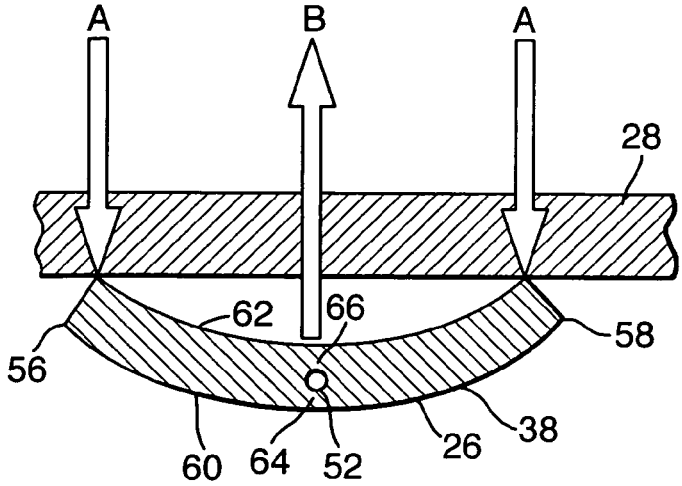
FIG. 6 is a diagrammatic illustration of a fan blade root impacting a fan casing.
Figure 4:
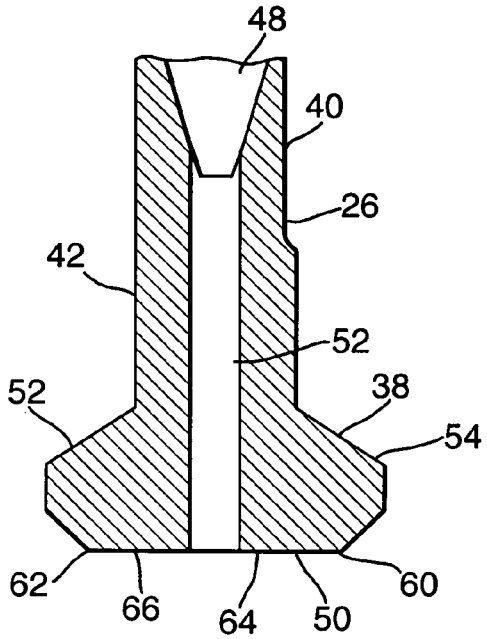
FIG. 4 is an enlarged cross-sectional view of the root of the fan blade shown in FIG. 2.

In operation of the turbofan gas turbine engine 10, in the event of a fan blade 26 becoming detached from the fan rotor 24 due to an impact from a foreign object, the tip of the aerofoil portion 36 of the fan blade 26 initially strikes the main containment region of the fan casing 28. The fan blade 26 generally progressively breaks up under a buckling action. Thereafter the root portion 38 of the fan blade 26 impacts the rear containment region of the fan casing 28, as shown in FIG. 6.

The at least one aperture 52 provides a hinge point that results in high stresses and deformation of the root portion 38 when radially inward reaction loads A are applied to the ends 56 and 58 of the base 50 of the root portion 38 of the fan blade 26 by the fan casing 28 and a radially outward load B is applied to the middle of the root portion 38 of the fan blade 26 by the inertia, centrifugal force, of the fan blade 26. The high stresses at the aperture 52 are due to the reduced load bearing area in the root portion 38 and the stress concentration in the root portion 38 caused by the aperture 52. The deformation of the root portion 38 of the fan blade 26 results in dissipation of the impact energy of the root portion 38 of the fan blade 26 by plastic deformation and/or fracturing of the root portion 38 of the fan blade 26. There is a reduction of the peak load on the fan casing 28 and an increase in the area of the fan casing 28 over which the impact load of the root portion 38 of the fan blade 26 is applied as the curved root portion 38 is straightened and progressively more of the middle of the root portion 38 of the fan blade 26 contacts the rear containment region of the fan casing 28. The deformation of the root portion 38 of the fan blade 26 may result in fracturing of the root portion 38 of the fan blade 26 into one or more portions.

The at least one aperture 52 is shaped, dimensioned and positioned with respect to the root portion 38 such that during an impact with the rear fan containment region of the fan casing 28 there is sufficient stress to cause the material of the root portion 38 of the fan blade 26 around the at least one aperture 52 to yield, that is the stress in the regions 64 and 66 of the root portion 38 between the peripheral edge of the at least one aperture 52 and the sides 60 and 62 of the base 50 of the root portion 38 of the fan blade 26.

An advantage of the present invention is that an impact of the root portion 38 of the fan blade 26 produces less damage to the rear containment region of the fan casing 28, compared to a solid root portion of a fan blade. This enables detached fan blades 26 to be contained within the fan casing 28 without adding material, and hence weight, to the fan casing 28 and thus this reduces, minimises, the weight of the fan casing 28.

During normal operation of the turbofan gas turbine engine 10 the alignment, position and dimensions of the at least one aperture 52 produce no significant stress in the root portion 38 of the fan blade 26. The root portion 38 of of the fan blade 26 is also more compliant for more even bedding during normal operation.

Figure 7:
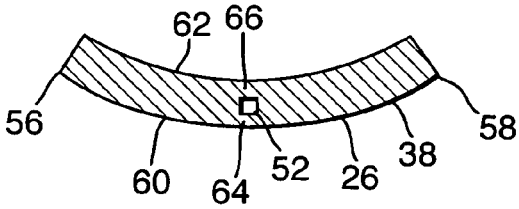
FIG. 7 is an alternative cross-sectional view along line X—X of a base of the root of the fan blade shown in FIG. 2.
Figure 8:
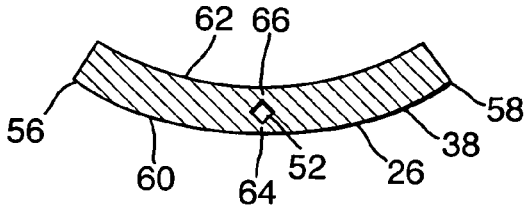
FIG. 8 is a further alternative cross-sectional view along line X—X of a base of the fan blade shown in FIG. 2.
Figure 5:
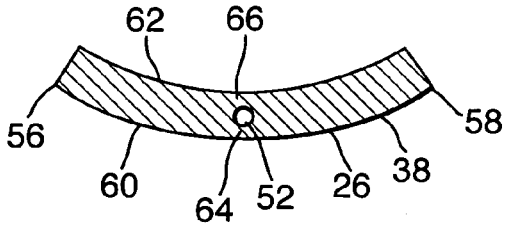
FIG. 5 is a cross-sectional view along line X—X of a base of the root of the fan blade shown in FIG. 2.

FIGS. 7 and 8 show alternative apertures 52. In FIG. 7 the aperture 52 is substantially square with two of the sides of the aperture 52 arranged substantially parallel to a straight line between the ends 56 and 58. In FIG. 8 the aperture 52 is substantially square with the sides of the aperture 52 arranged substantially at 45° to a straight line between the ends 56 and 58.

It has been found that an aperture 52 which is substantially square with rounded corners is the best shape for a relatively large fan blade 26, having a length about 1.0 m from root to tip. In the case of a titanium fan blade 26 comprising an alloy consisting of 6 wt % aluminium, 4 wt % vanadium and the balance titanium plus other minor additions and incidental impurities the at least one aperture 52 in the root portion 38 of the fan blade 26 is arranged to produce a stress of 1100 MPa to 1600 MPa in the regions 64 and 66 of the root portion 38 between the peripheral edge of the at least one aperture 52 and the sides 60 and 62 of the base 50 of the root portion 38 of the fan blade 26.

The dimension of a single aperture 52 is between 8 mm and 14 mm, for example 8 mm, 10 mm, 12 mm or 14 mm, and is preferably 12 mm for a relatively large fan blade 26 having a length of about 1.0 m from root to tip and a dimension between the sides 60 and 62 of the base 50 of the root portion of about 18 mm. The dimension may be a diameter of a circular aperture or the distance along a side of a polygonal aperture.

The dimensions of the at least one aperture in the direction between the sides 60 and 62 are ideally between 40% and 80% of the dimension between the sides 60 and 62 of the base 50 of the root portion 38 of the fan blade 26. Preferably the dimensions of the at least one aperture in the direction between the sides 60 and 62 are between 50% and 70% of the dimension between the sides 60 and 62 of the base 50 of the root portion 38 of the fan blade 26 and more preferably the dimension of the aperture 52 is about 66% of the dimension between the sides 60 and 62 of the base 50 of the root portion 38 of the fan blade 26.

Figure 9:
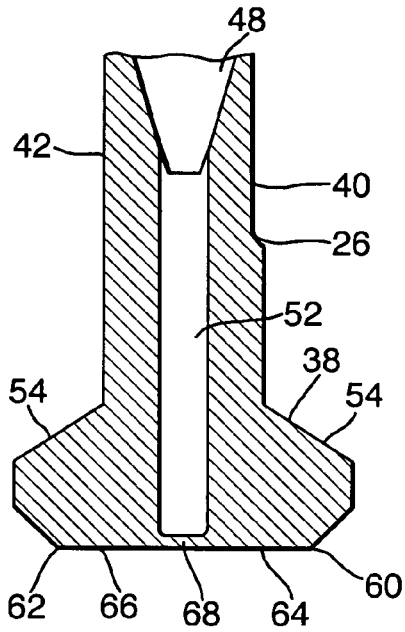
FIG. 9 is an alternative enlarged cross-sectional view of the root of the fan blade shown in FIG. 2.

In FIG. 9 the root portion 38 of the fan blade 26 is provided with a seal 68 at the base 50 to maintain the vibration damping material in the at least one internal chamber 48.

Figure 2:
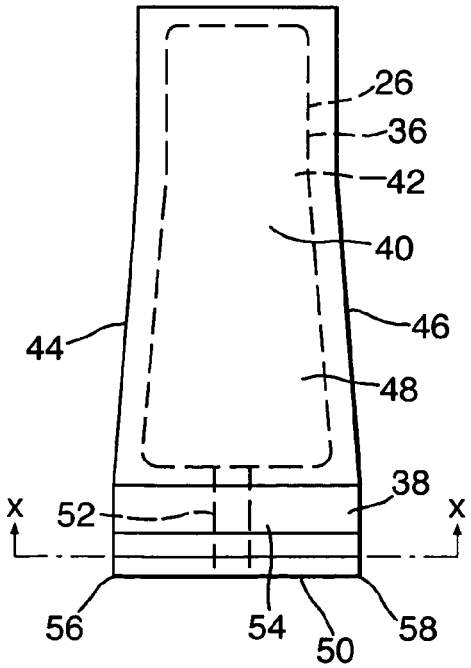
FIG. 2 is an enlarged view of the fan blade according to the present invention shown in FIG. 1.
Figure 10:
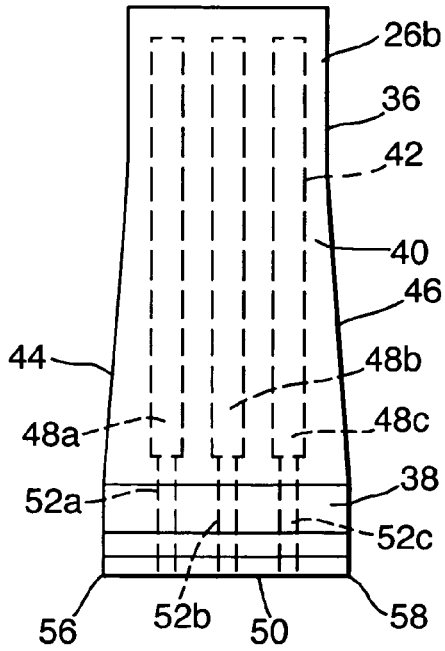
FIG. 10 is an alternative enlarged view of the fan blade according to the present invention shown in FIG. 1.
Figure 3:
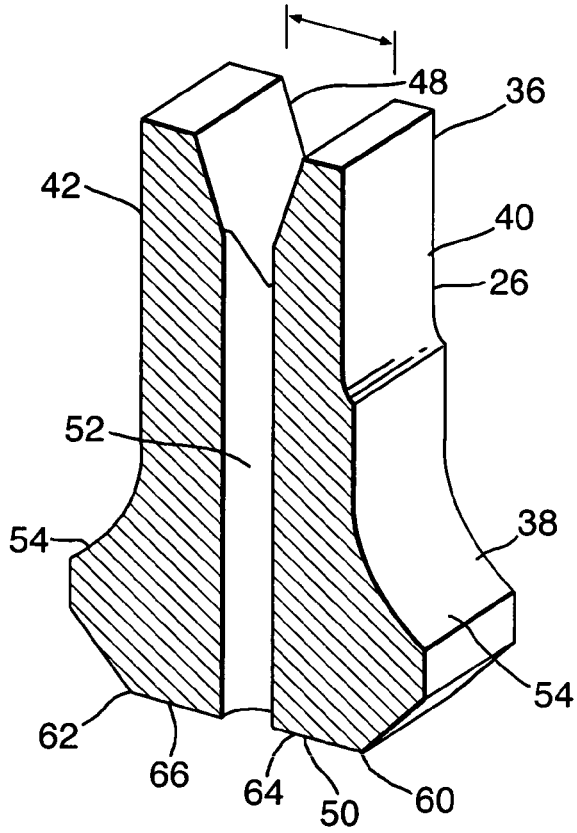
FIG. 3 is a further enlarged cut away perspective view of a root of the fan blade shown in FIG. 2.

An alternative fan blade 26B according to the present invention is shown in FIG. 10 and is substantially the same as the fan blade 26 shown in FIG. 2 and like parts are denoted by like numerals. The fan blade in FIG. 10 differs in that there are a plurality, three, of internal chambers 48A, 48B and 48C within the aerofoil portion 36 of the fan blade 26B and there are a plurality of apertures 52A, 52B and 52C extending from the base 50 to the internal chambers 48A, 48B and 48C respectively.

The fan blade 26B is preferably manufactured from two or more metal, e.g. titanium alloy, sheets, which have been diffusion bonded together. If the fan blades 26B are manufactured from three or more metal sheets, one or more of the metal sheets are superplastically formed by gas pressure to produce a warren girder structure and a plurality of internal chambers 48A, 48B and 48C within the aerofoil portion 36.

It may be possible to provide a single aperture extending from the base to one of the internal chambers in the fan blade shown in FIG. 10 in a similar manner to FIG. 2.

The apertures may be circular, rectangular, square, triangular, pentagonal, hexagonal, other polygonal shape or other suitable shape in cross-section. The apertures may be uniform in cross-sectional area along their length, may increase in cross-sectional area from the base to the internal chamber or may decrease in cross-sectional area from the base to the internal chamber. The apertures are preferably dimensioned to be large enough to form slots on the inside surface of one or both of the convex wall and concave wall of the internal chamber in the aerofoil portion of the fan blade. The maximum dimension of the at least one aperture is limited by the dimension of the at least one internal chamber between the concave wall and the convex wall in the aerofoil portion of the fan blade and the maximum dimension may be about 20 mm.

There may be a plurality of apertures spaced apart in the direction between the ends of the base of the root portion at the mid region of the base of the root portion. There may be a plurality of apertures spaced apart in the direction between the sides of the base of the root portion at the mid region of the base of the root portion.

The at least one aperture may be formed in the root portion of the fan blade by drilling, laser drilling, electrochemical machining or other suitable process. The at least one aperture is preferably provided with a thin seal at the base to maintain a vacuum or a gas in the at least one internal chamber or to maintain a vibration damping material in the at least one internal chamber. The seal may be provided at other suitable positions along the aperture except adjacent the internal chamber.

The at least one aperture is preferably formed in the root portion of the fan blade by forming, machining, one or more channels in the abutting surfaces of one or more of the sheets prior to diffusion bonding the sheets together. The channels in abutting sheets are aligned to form the at least one aperture. In the case of a fan blade made from three sheets, the channel in the centre sheet may extend completely through the centre sheet.

The thin seal at the base of the root portion of the fan blade is advantageously produced by forming, machining, one or more channels in the abutting surface of one or more of the sheets prior to diffusion bonding such that the channels do not extend to the base of the root portion of the fan blade. Alternatively an epoxy adhesive maybe used to form the seal.

The fan blade may comprise a shank portion between the root portion and the aerofoil portion and the at least one aperture extends through the shank portion.

Although the present invention has been described with reference to a fan blade, the present invention is equally applicable to compressor blades.

I claim:

1. A fan blade comprising an aerofoil and a root, the aerofoil comprising a concave wall extending from a leading edge to a trailing edge and a convex wall extending from the leading edge to the trailing edge, the aerofoil defining at least one internal chamber, the root being connected to the aerofoil, the root having a base remote from the aerofoil and at least one aperture extending from the base of said root to the at least one internal chamber in the aerofoil wherein the base has sides and ends, the dimensions of the at least one aperture is between 40% and 80% of the dimension between the sides of the base such that the root is deformable and the ends of the base are adjacent to the leading edge and trailing edge of the aerofoil, the sides of the base being adjacent the concave wall and convex wall of the aerofoil wherein the at least one aperture is provided with a seal.

2. A fan blade as claimed in claim 1 wherein the root is dovetail shaped or firtree shaped in cross-section.

3. A fan blade as claimed in claim 1 wherein the root is connected to the aerofoil by a shank, the at least one aperture extending through the shank.

4. A fan blade as claimed in claim 1 wherein the aerofoil has a plurality of internal chambers, the at least one aperture extending to at least one of the internal chambers.

5. A fan blade as claimed in claim 1 wherein the base has ends, the at least one aperture is at a position mid way between the ends of the base of the root.

6. A fan blade as claimed in claim 1 wherein the base has sides, the at least one aperture is at a position mid way between the sides of the base of the root.

7. A fan blade as claimed in claim 1 wherein the at least one aperture is circular, rectangular, square or other suitable shape in cross-section.

8. A fan blade as claimed in claim 1 wherein the fan blade comprises two or more sheets and the sheets are diffusion bonded together.

9. A fan blade as claimed in claim 8 wherein at least one of the sheets has been superplastically formed.

10. A fan blade as claimed in claim 1 wherein the at least one internal chamber is evacuated.

11. A fan blade as claimed in claim 1 wherein the apertures in the root of the fan blade are dimensioned to form slots on the inside surface of one or both of the convex wall and the concave wall of the at least one internal chamber in the aerofoil.

12. A fan blade as claimed in claim 1 wherein the dimensions of the at least one aperture in the direction between the sides of the base is between 50% and 70% of the dimension between the sides of the base.

13. A fan blade as claimed in claim 12 wherein the dimensions of the at least one aperture in the direction between the sides of the base is about 66% of the dimension between the sides of the base.

14. A fan blade as claimed in claim 1 wherein that at least one internal chamber is at least partially filled with a vibration damping material.

15. A fan blade comprising an aerofoil and a root, the aerofoil comprising a concave wall extending from a leading edge to a trailing edge and a convex wall extending from the leading edge to the trailing edge, the aerofoil defining at least one internal chamber, the root being connected to the aerofoil, the root having a base remote from the aerofoil and at least one aperture extending from the base to the at least one internal chamber in the aerofoil, the dimensions, shape and position of the at least one aperture are selected such that the root is deformable wherein there are a plurality of apertures extending from the base of the root to the at least one chamber.

16. A fan blade comprising an aerofoil and a root, the aerofoil comprising a concave wall extending from a leading edge to a trailing edge and a convex wall extending from the leading edge to the trailing edge, the aerofoil defining at least one internal chamber, the root being connected to the aerofoil, the root having a base remote from the aerofoil and at least one aperture extending from the base to the at least one internal chamber in the aerofoil, the dimensions, shape and position of the at least one aperture are selected such that the root is deformable wherein the maximum dimension of the aperture is limited by the maximum dimension of the at least one internal chamber in the aerofoil.

17. A fan blade as claimed in claim 16 wherein the at least one aperture comprises channels machined in the abutting surfaces of one or more of the sheets prior to diffusion bonding the sheets together.

18. A fan blade comprising an aerofoil and a root, the aerofoil comprising a concave wall extending from a leading edge to a trailing edge and a convex wall extending from the leading edge to the trailing edge, the aerofoil defining at least one internal chamber, the root being connected to the aerofoil, the root having a base remote from the aerofoil and at least one aperture extending from the base to the at least one internal chamber in the aerofoil, the dimensions, shape and position of the at least one aperture are selected such that the root is deformable wherein the at least one chamber is at least partially filled with a vibration damping material.

19. A fan blade comprising an aerofoil and a root, the aerofoil comprising a concave wall extending from a leading edge to a trailing edge and a convex wall extending from the leading edge to the trailing edge, the aerofoil defining at least one internal chamber, the root being connected to the aerofoil, the root having a base remote from the aerofoil and at least one aperture extending from the base to the at least one internal chamber in the aerofoil, the dimensions, shape and position of the at least one aperture are selected such that the root is deformable wherein the dimension of the at least one aperture in the direction between the sides of the base is between 8 mm and 14 mm, the base has sides and ends, the dimension between the sides is about 18 mm.

20. A fan blade comprising an aerofoil and a root, the aerofoil comprising a concave wall extending from a leading edge to a trailing edge and a convex wall extending from the leading edge to the trailing edge, the aerofoil defining at least one internal chamber, the root being connected to the aerofoil, the root having a base remote from the aerofoil, the base having sides and ends, the root having at least one aperture extending from the base to the at least one internal chamber in the aerofoil, the dimensions, shape and position of the at least one aperture are selected such that the root is deformable, the at least one aperture is provided with a seal and the dimensions of the at least one aperture is between 40% and 80% of the dimension between the sides of the base.

21. A fan blade comprising an aerofoil and a root, the aerofoil comprising a concave wall extending from a leading edge to a trailing edge and a convex wall extending from the leading edge to thetrailing edge, the aerofoil defining at least one internal chamber, the root being connected to the aerofoil, the root having a base remote from the aerofoil and at least one aperture extending from the base to the at least one internal chamber in the aerofoil wherein the base has sides and ends, the dimensions of the at least one aperture is between 40% and 80% of the dimension between the sides of the base such that the root is deformable and the ends of the base are adjacent to the leading edge and trailing edge of the aerofoil, the sides of the base being adjacent the concave wall and convex wall of the aerofoil wherein the fan blade comprises two or more sheets and the sheets are diffusion bonded together wherein the at least one aperture comprises a channel in the centre sheet.

22. A fan blade as claimed in claim 21 wherein the channel extends completely through the centre sheet.

* * * * *